US005577954A

United States Patent [19]

Okumura et al.

[11] Patent Number: 5,577,954

[45] Date of Patent: Nov. 26, 1996

[54] GRINDING APPARATUS OF WELDED RESIDUE ON SEAM OF RAIL HEAD

[75] Inventors: Yosiaki Okumura; Shinichi Okumura, both of Iwaki, Japan

[73] Assignee: Tohokugiken Industries Co., Ltd., Fukusima-ken, Japan

[21] Appl. No.: 430,396

[22] Filed: Apr. 28, 1995

[30] Foreign Application Priority Data

Mar. 10, 1995 [JP] Japan ..... 7-050821
Apr. 11, 1995 [JP] Japan ..... 7-085227

[51] Int. Cl.[6] ..... B24B 9/00; B24B 23/02; B24B 27/08

[52] U.S. Cl. ..... 451/179; 15/54; 451/347; 451/543

[58] Field of Search ..... 15/54, 55; 409/175; 451/178, 179, 347, 542, 543, 544, 547

[56] References Cited

U.S. PATENT DOCUMENTS

| | | | |
|---|---|---|---|
| 1,923,020 | 8/1933 | Fox | 451/347 X |
| 3,324,603 | 6/1967 | Niemiec | 451/542 |
| 3,427,758 | 2/1969 | Guntermann | 451/347 |
| 4,365,918 | 12/1982 | Theurer | 451/347 X |

FOREIGN PATENT DOCUMENTS

| | | | |
|---|---|---|---|
| 3711328 | 6/1990 | European Pat. Off. | 451/347 |
| 60-181402 | 9/1985 | Japan . | |
| 776801 | 3/1995 | Japan . | |
| 724550 | 5/1995 | Japan . | |
| 2055649 | 3/1981 | United Kingdom | 451/347 |

*Primary Examiner*—Timothy V. Eley
*Attorney, Agent, or Firm*—Rodman & Rodman

[57] ABSTRACT

A grinding apparatus of a welded residue on a seam of a rail head portion including a rail, a machine table capable of moving forward and backward along the rail, an apparatus base erected on a distal end side of the machine table, a first support disk board mounted on the apparatus base and capable of moving vertically by electric power or an operator's hand, a second support disk board mounted on the first support disk board and capable of moving vertically by electric power or an operator's hand, a grinding drive motor mounted on a front surface of the second support disk board and capable of rotating about a horizontal axis, a cutter unit mounted on the front surface of the second support disk board and capable of rotating about the horizontal axis, the cutter unit being operatively connected to the grinding drive motor, an engaging portion formed on the cutter unit and adapted to engage a head portion of the rail, and a grinding edge disposed on the engaging portion and adapted to grind an upper surface, an arcuate surface and a side surface of the rail head portion.

13 Claims, 10 Drawing Sheets

57
42
43
37b'
37a
37b
41
39
44
42
47
45
49
R'
R'a
R'c
R'b
R'd
R
40

GRINDING APPARATUS OF WELDED RESIDUE ON SEAM OF RAIL HEAD

BACKGROUND OF THE INVENTION

1. Field of the Invention

This invention relates to a grinding apparatus for grinding a welded residue which remains at the connecting seam of a rail head when a rail is connected.

2. Brief Description of the Prior Art

As used herein, the terms rail head and head portion of a rail are used synonymously.

A known apparatus for grinding a rail head is disclosed in Japanese Patent Application Laid-Open No. SHO 60-181402. This conventional grinding apparatus is designed for reproducing a rail and chiefly used for prolonging the service life of the rail by correctly reshaping very small convexities and concavities, or damages caused as a result of long use of the rail. In this conventional grinding apparatus, a grinder is rotatably supported by each support element of a windmill-like support member. The support member is rotated to position a selected one of the support elements. The upper surface, arcuate surface and side surface of the rail head are ground by the grinder of a selected support element.

Although the known apparatus performs the function of grinding a rail, it has the following shortcomings. Since the apparatus is constituted of a grinder, a relatively long period of time is required to complete a grinding operation. Further, the preparatory set-up for a grinding procedure requires selection of one of several grinders including support elements that must be brought to a desired location of the rail head. Consequently, the grinding procedure is complicated and arduous.

The present invention has been developed in response to the above described shortcomings of the known grinding apparatus.

SUMMARY OF THE INVENTION

It is, therefore, an object of the present invention to provide a grinding apparatus for a welded residue of a seam of a rail head, which facilitates and simplifies grinding of the rail head.

To achieve the above object, according to the present invention, there is provided a grinding apparatus for a welded residue on a seam of a rail head including a machine table capable of moving forward and backward along the rail, an apparatus base on a distal end side of the machine table, a first support disk board mounted on the apparatus base and capable of moving vertically by electric power or manual operation, a second support disk board mounted on the first support disk board and capable of moving vertically by electric power or manual operation, a grinding drive motor mounted on a front surface of the second support disk board and rotatable about a horizontal axis, a cutter unit mounted on the front surface of the second support disk board and rotatable about the horizontal axis, the cutter unit being connected to the grinding drive motor, an engaging portion formed on the cutter unit and adapted to engage a head portion of the rail, and a grinding edge disposed on the engaging portion and adapted to grind an upper surface, an arcuate surface and a side surface of the rail head.

In addition to the above construction, the following means are employed so that grinding operation can be performed reliably and correctly.

1) At least one pair of front and rear carrier rollers capable of rolling contact with the upper surface of the rail head, a pair of depending right and left pinch rollers in the vicinity of each of the carrier rollers, the pinch rollers being constituted of an upper member capable of rolling contact with the upper and side surfaces of the rail head, and a lower member capable of rolling contact with a lower surface of the rail head, and a cylinder unit mounted on the machine table and adapted to cause the upper and lower members to intimately contact the rail head.

2) The pinch rollers on one side of the rail head are mounted in fixed position on the machine table, and the pinch rollers on the other side of the rail head are adjustably mounted on the machine table for movement in a direction toward and away from the pinch rollers on the one side of the rail head.

3) The pinch rollers are rotatably supported on a piston rod of a hydraulic cylinder located on the machine table.

4) A thrust bearing with a piston rod that extends therethrough is interposed between the machine table and the pinch rollers, one side of the thrust bearing being in pressure contact with the machine table and the other side being in pressure contact with the upper side of the pinch rollers.

5) An intermediate block with a thrust bearing engaged therewith is disposed on the pinch roller on the other side, the intermediate block being provided with a threaded hole horizontally formed therein, a threaded rod being threadedly engaged with the threaded hole, opposite end portions of the threaded rod being rotatably supported by a support element disposed on the machine table, a control handle being attached to one end of the threaded rod projecting from the machine table through the support element.

Also, a central constitutional section provided with a grinding edge for grinding the upper surface of the rail head portion is interposed between a pair of first and second side constitutional sections provided with a grinding edge for grinding the arcuate surface and the side surface of the rail head, and a key formed on a main shaft is brought into engagement with a key groove formed in each constitutional section, thereby constituting the cutter unit. Accordingly, the cutter unit is relatively easy to manufacture. Further, the grinding edge is detachably attached to the cutter unit. More specifically, the cutter unit is provided with a mounting recess, the grinding edge being engaged in the mounting recess, the grinding edge being secured to the cutter unit by a pressing element which is fastened tight by a fastening screw, so that the grinding edge is secured to the cutter unit. Accordingly, the cutter unit has enhanced wear resistance. Furthermore, grinding edges are disposed on several locations of the cutter unit such that the rotating orbit of each grinding edge coincides with a corresponding surface portion of the rail head. Accordingly, the welded residue can be easily ground by a relatively small amount of movement of the first or second support disk board. In addition, the grinding edges are made of a super-hard chip or ceramic chip. Accordingly, the grinding can be more effectively performed by using a super-hard chip for the grinding edges.

By moving the first support disk board vertically and moving the second support disk board horizontally, the grinding edges are caused to contact, either at the same time or at different times, the upper surface, arcuate surface and side surface of the head portion of the rail, so that the welded residue on the seam of the rail head is ground. By moving the machine table forward and backward, the grinding position can be changed in the longitudinal direction of the rail.

The pinch roller is constituted of a pair of upper and lower elements so that the rail head portion is pinched therebetween during the grinding operation. Also, the rail head is pinched from the right and left directions by the pinch roller on one side of the rail head and the pinch roller on the other side. Accordingly, the cutter unit, namely, the grinding edges, are not displaced from a predetermined position, and the pinch roller is enabled to effectively pinch the rail head portion through operation of the hydraulic cylinder or the threaded rod.

When the grinding edge has been worn, it can be easily replaced by a new one. The replacement of the grinding edge is performed simply by manipulating the tightening screw.

The above and other objects and attendant advantages of the present invention will be apparent to those skilled in the art from a reading of the following description and claims in conjunction with the accompanying drawings which constitute part of this specification.

DETAILED DESCRIPTION OF THE EMBODIMENT

The present invention will now be described in detail with reference to the accompanying drawings which illustrate one embodiment of a grinding apparatus of a welded residue on a seam of a rail head according to the present invention. It should be appreciated, however, that the preferred embodiment herein described is not intended to limit the invention to the precise form disclosed but to explain and illustrate the principles of the invention, its application and its practical use to enable others skilled in the art to utilize the invention. The drawings show the rail is being ground by a) the central constitutional section, b) the central constitutional section and the first side constitutional section, and c) the central constitutional section and the second side constitutional section.

Figure 1:
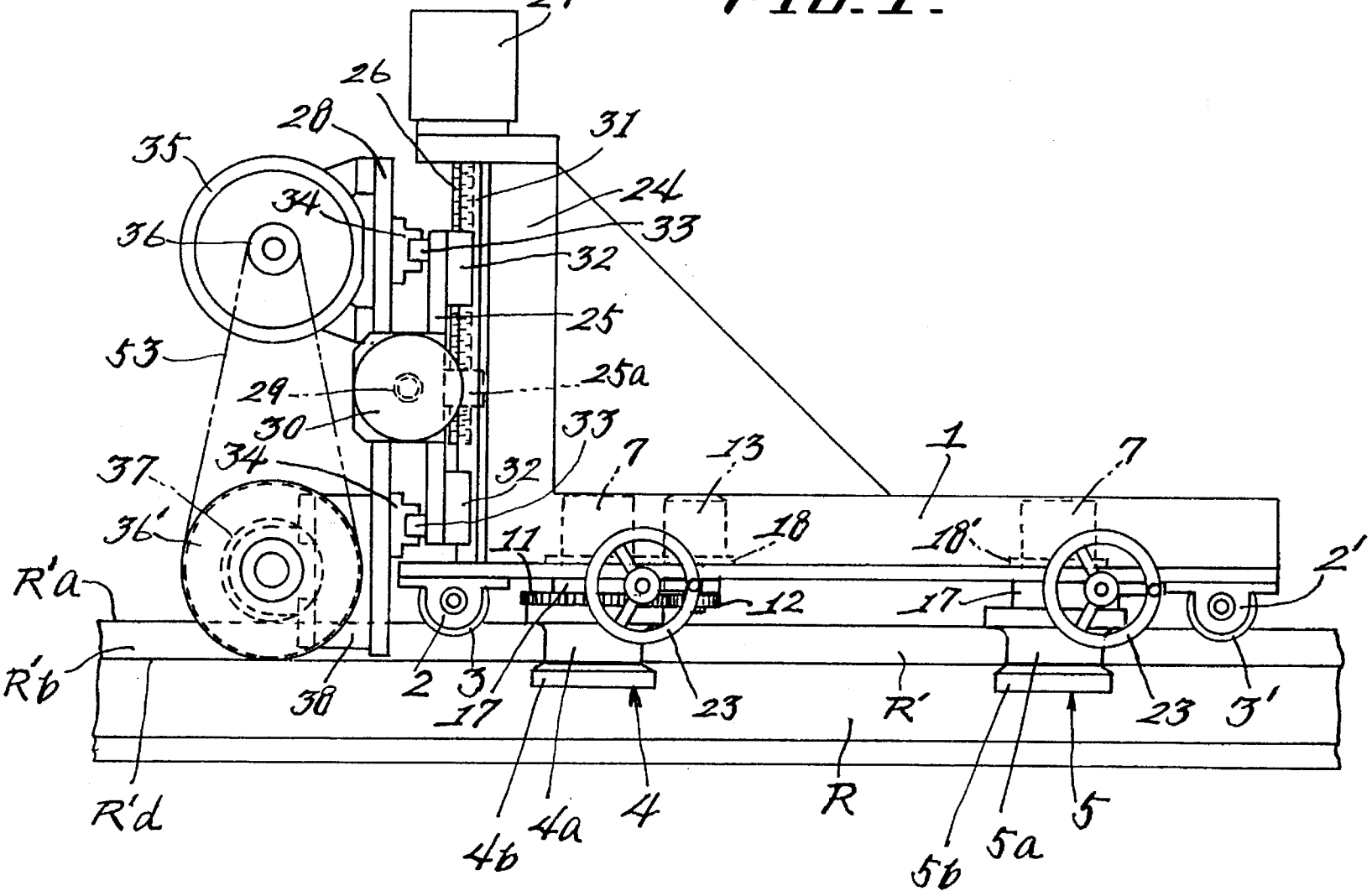
FIG. 1 is a schematic side view of a grinding apparatus of a welded residue on a seam of a rail head portion according to one embodiment of the present invention.
Figure 2:
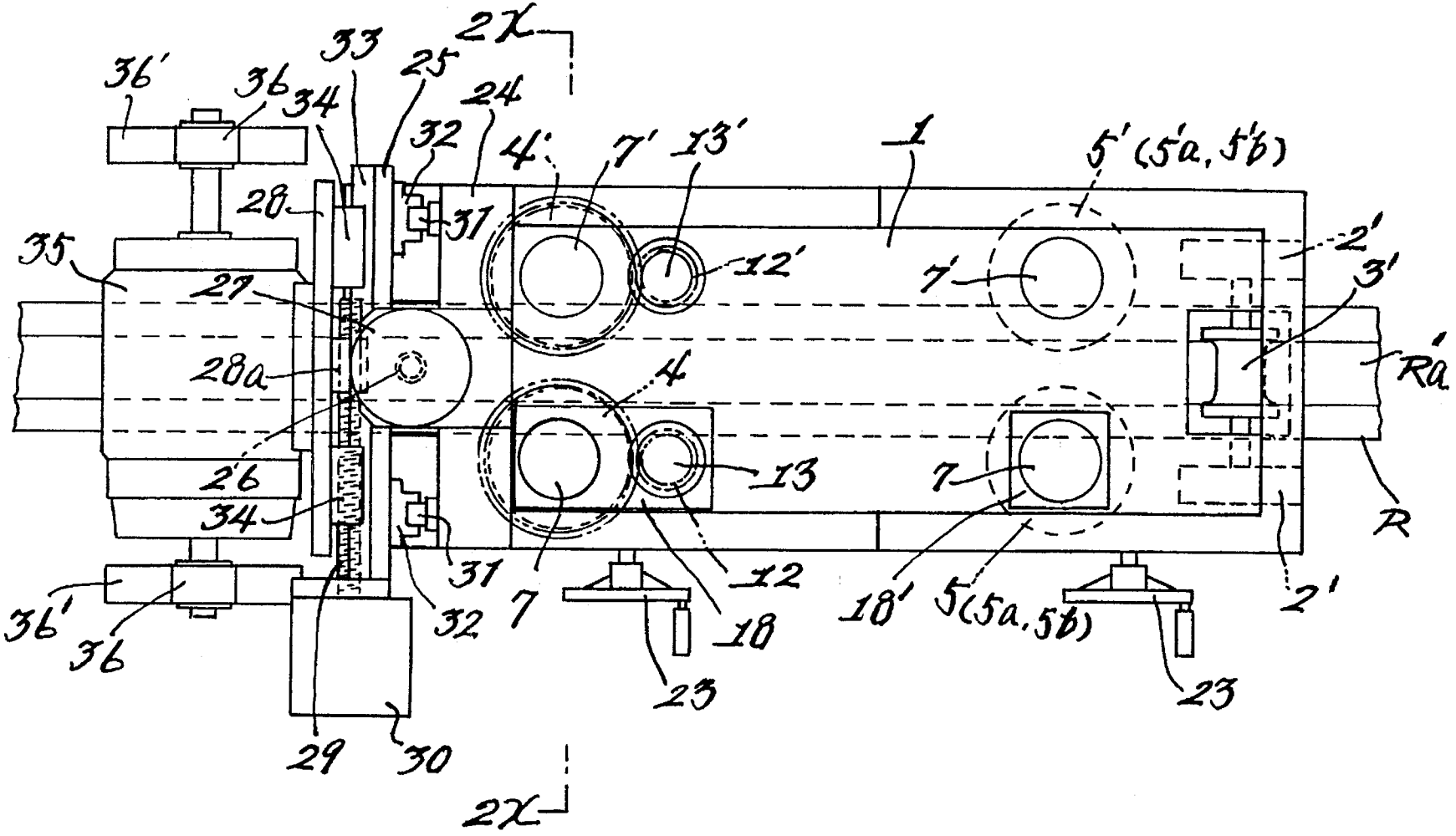
FIG. 2 is a schematic plan view of the grinding apparatus of FIG. 1.
Figure 3:
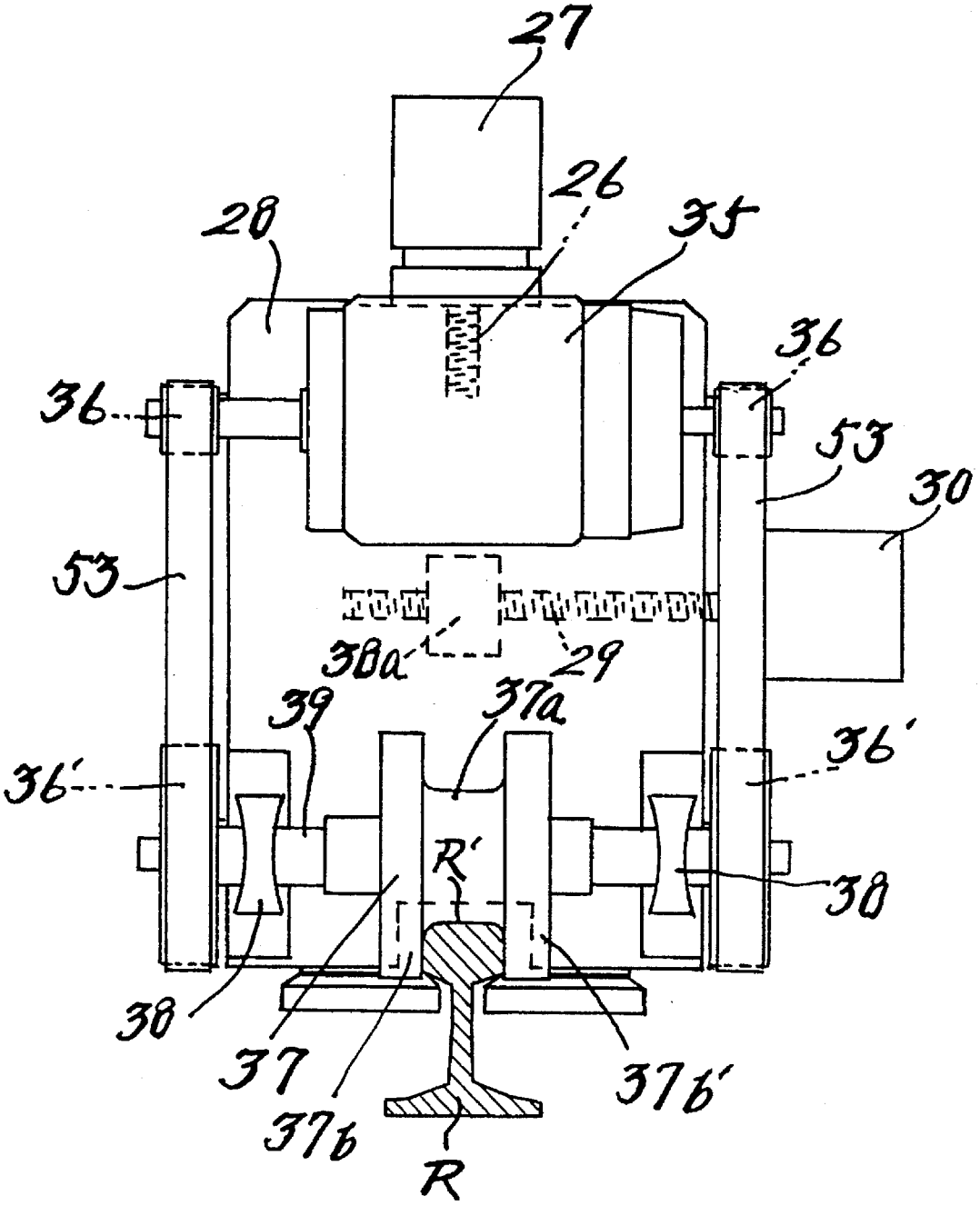
FIG. 3 is a schematic front view of the grinding apparatus of FIG. 1.
Figure 4:
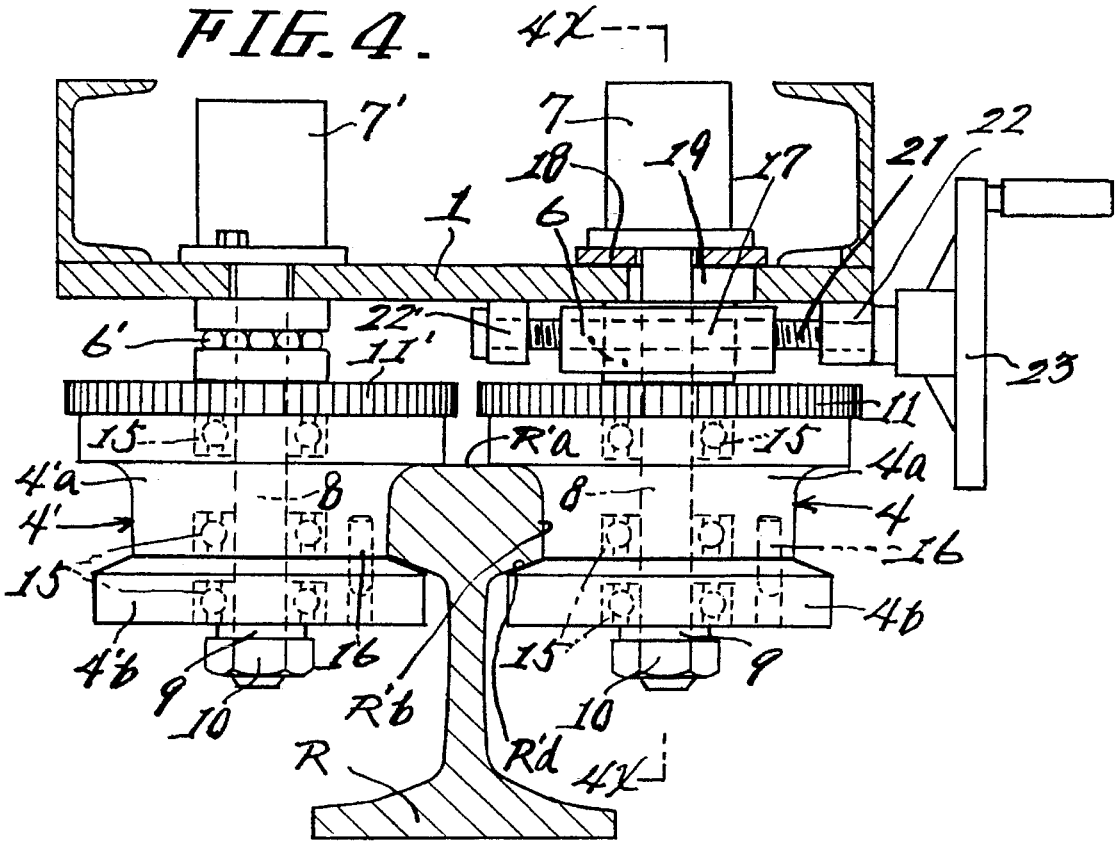
FIG. 4 is a sectional view taken on line 2X—2X of FIG. 2.
Figure 5:
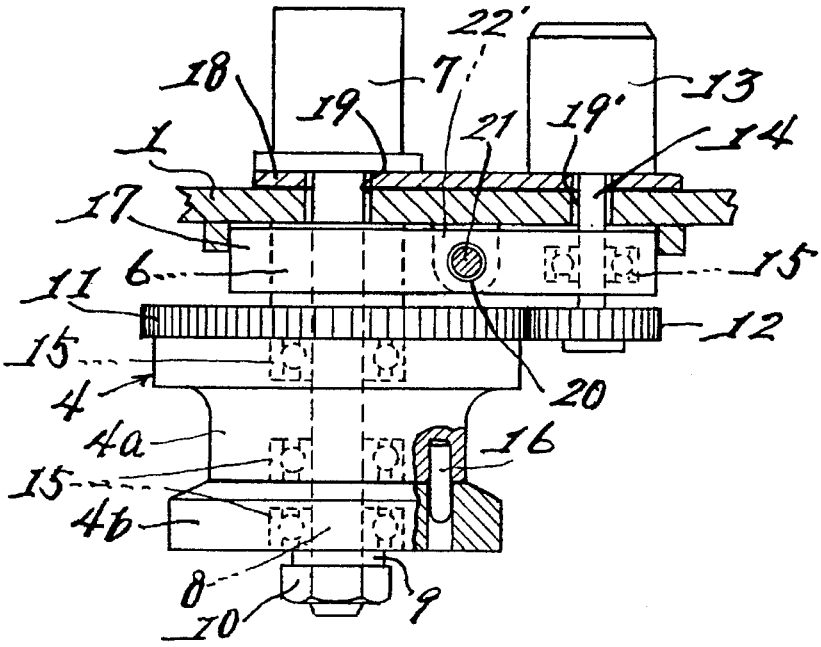
FIG. 5 is sectional view taken on line 4X—4X of FIG. 4.
Figure 6:
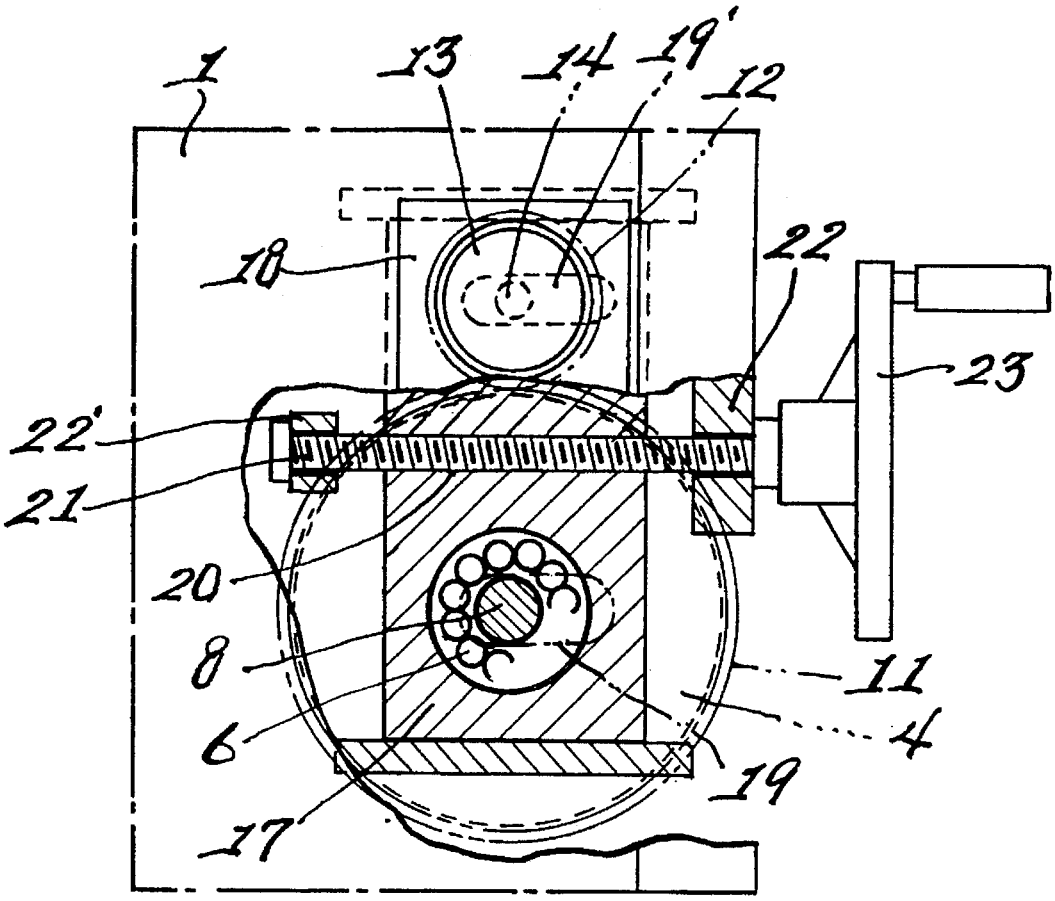
FIG. 6 is a plan view, partly cut away, of FIG. 5.

In the drawings, reference numeral 1 denotes a machine table. A pair of front roller frames 2, 2 and a pair of rear roller frames 2', 2' are secured to a lower side of the machine table 1. A front carrier roller 3 is rotatably supported by the front roller frames 2, 2, and a rear carrier roller 3' is rotatably supported by the rear roller frames 2', 2'. The front and rear carrier rollers 3, 3' are placed on an upper surface R'a of a head portion R' of a rail R such that the front and rear carrier rollers 3 and 3' can roll on the upper surface R'a. The machine table 1 is carried on the front and rear carrier rollers 3 and 3'. A pair of right and left front pinch rollers 4, 4' depending from the machine table 1 are oriented in an area in the vicinity of the front carrier roller 3, whereas a pair of rear right and left pinch rollers 5, 5' depending from the machine table 1 are oriented in an area in the vicinity of the rear carrier roller 3'. The front pinch rollers 4, 4' and the rear pinch rollers 5, 5' are constituted of upper members *4a*, *4'a* (FIG. 4) and *5a*, *5'a* (FIG. 2). The upper members *5a* and *5'a* are correspondingly similar to the upper members *4a* and *4'a*, as shown schematically in FIG. 2. The upper members *4a*, *4'a* and *5a*, *5'a* are capable of rolling contact with the upper surface R'a, and a side surface R'b of the rail head R'. The pinch rollers 4, 4' include lower members *4b*, *4'b* (FIG. 4) and *5b*, *5'b*. The lower members *5b* and *5'b* are correspondingly similar to the lower members *4b* and *4'b*, as shown schematically in FIG. 2. The lower members *4b*, *4'b* and *5b*, *5'b* of the pinch rollers 4, 4' and 5, 5' are capable of rolling contact with a lower surface R'd of the rail head R'.

Thrust bearings 6, 6' (similar thrust bearings for the rear pinch rollers 5, 5' on the rear side of the machine table 1 are not shown) are disposed on the upper side of the front pinch rollers 4, 4' and the rear pinch rollers 5, 5'. Pistons 8, 8 of hydraulic cylinders 7, 7' extend through the upper and lower members *4a*, *4b* and *4'a*, *4'b*, *5a*, *5b*, *5'a*, *5'b* and through the thrust bearings 6, 6'. Then, tightening nuts 10, 10, which are threadedly engaged with distal ends of the piston rods 8, 8 through washers 9, 9 are tightened. In this manner, the front pinch rollers 4, 4' and the rear pinch rollers 5, 5' are arranged to depend from the machine table 1 as described above. The front pinch rollers 4, 4' and the rear pinch rollers 5, 5' are rotated about the respective piston rods 8, for each pinch roller as vertical axes. The pinch rollers 4, 4', 5, 5' are mounted on the respective piston rods 8 through a bearing (radial) 15.

Driven gears 11, 11' are secured to the pair of front pinch rollers 4, 4' on the front side of the machine table 1. The driven gears 11, 11' are interposed between the pinch rollers 4, 4' and the thrust bearings 6, 6', respectively The piston rods 8, 8 extend through the driven gears 11, 11', respectively The driven gears 11, 11' are in engagement with driving gears 12, 12', respectively. The driving gears 12, 12' are rotated about motor shafts 14 (a motor shaft on the side of the drive motor 13' is not shown) of machine table drive motors 13, 13' which are located on the machine table 1 and rotated clockwise and counterclockwise and vice versa, in order to move the machine table 1 forwardly and backwardly. The driving gears 12, 12' rotate the upper members *4a*, *4'a* of the front pinch rollers 4, 4' through the driven gears 11, 11', respectively The upper members *4a*, *4'a* are each provided with a transmission pin 16 projecting from a lower surface of the upper member *4a*, *4'a*. The lower members *4b*, *4'b* are rotated in unison with the upper members *4a*, *4'a* by causing the transmission pins 16 to engage the lower members *4b*, *4'b*, respectively.

The upper members *5a*, *5'a* and the lower members *5b*, *5'b* of the pair of rear pinch rollers 5, 5' are also rotated in unison using a similar transmission pin 16.

It is not absolutely necessary that the upper members *4a*, *4'a*, *5a*, *5'a* and the lower members *4b*, *4'b*, *5b*, *5'b* be rotated in unison. For example, without using the transmission pin 16, the upper members *4a*, *4'a* of the pinch rollers 4, 4' are used as means for moving the machine table 1 but the lower members *4b, 4'b* are not used to move the machine table 1.

The hydraulic cylinders 7, 7' are placed on the machine table 1, and the piston rods 8 extend through the machine table 1 and project downwardly of the machine table 1 in order to support the pinch rollers 4, 4', 5, 5'.

The thrust bearing 6 on one side of the rail R is in engagement with the intermediate block 17.

The thrust bearings 6, 6' are mounted between the machine table 1 and the upper members *4a, 4a'* of the pinch rollers 4, 4', and between the machine table 1 and the upper members *5a*, 5' of the rear pinch rollers 5, 5' for securement to the driven gears 11, 11'. Actuation of the hydraulic cylinders 7, 7' sandwiches the thrust bearings 6, 6' between the machine table 1 and the driven gears 11 and 11'. By virtue of the foregoing arrangement, the respective pinch rollers 4, 4', 5, 5' are rotated relative to the machine table 1.

The hydraulic cylinders 7', 7' on the left side of the rail head portion R' at the pair of front and rear pinch rollers 4', 5' are tightened to the machine table 1 by bolt means. The hydraulic cylinders 7, 7 on the right side of the rail head R' at the pair of front and rear pinch rollers 4, 5 are placed on base plates 18, 18' which are movably disposed on the machine table 1. The piston rods 8 of the hydraulic cylinders 7, 7 extend into an elongate hole 19 (a corresponding similar piston rod and a lateral elongate hole on the rear side of the machine table are not shown) which is formed in the machine table 1. The motor shafts 14 of the drive motors 13, 13' also extend into a generally similar elongate hole 19'.

The pinch rollers 4, 5 are mounted on the machine table 1 such that they can be moved in a lateral direction toward the pinch rollers 4', 5'. A threaded hole 20 formed in each of the intermediate blocks 17 extends in a lateral direction from the pinch rollers 4 and 5 to the pinch rollers 4', 5'. A threaded rod 21 is threadedly engaged in each of the threaded holes 20. Opposite ends of the threaded rod 21 are rotatably supported by the support elements 22, 22' fixed to the machine table 1. A control handle 23 is attached to one end of each of the threaded rods 21 that projects through the support element 22.

The drive motor 13 on one side of the pinch roller 4 is supported with the hydraulic cylinder 7 on the base plate 18. The drive gear 12 is attached, as previously mentioned, to the piston rod 8 of the drive motor 13. The piston rod 8 extends through the intermediate block 17 and the bearing 15.

When the control handle 23 is manipulated, the threaded rod 21 supported by the support element 22, 22' is turned, and the intermediate block 17 with the threaded rod 21 threadedly engaged therein is moved along the threaded rod 21 together with the base plates 18, 18'. In other words, the intermediate block 17 is moved together with the hydraulic cylinder 7, pinch rollers 4, 5 and drive motor 7 so as to be intimately contacted with the rail head R'. The rail head R' is thus pinched between the pair of front pinch rollers 4, 4' and the rear pinch rollers 5, 5', which sandwich the rail head R'.

An apparatus base 24 is supported on a distal end side of the machine table 1. A first support disk board 25 is disposed on a front surface of the apparatus base 24. A threaded rod 26 threadedly engages an element *25a* of the first support disk board 25. The threaded rod 26 extends vertically along the front surface side of the apparatus base 24. A first drive motor 27 is mounted on the apparatus base 24. This first drive motor 27 is rotatable clockwise and counterclockwise in a selective manner to rotate the threaded rod 26 accordingly.

A second support disk board 28 is disposed on a front surface of the first support disk board 25. A threaded rod 29 is threadedly engaged with an element *28a* of the second support disk board 28. This threaded rod 29 is disposed across the front surface side of the first support disk board 28. A second drive motor 30 is supported by the second support disk board 28. The drive motor 30 is selectively rotatable clockwise and counterclockwise, to rotate the threaded rod 29 accordingly.

A pair of ridges 31, 31 are formed on the apparatus base 24 such that the ridges 31, 31 extend vertically. Vertically spaced groove blocks 32, 32 are provided on a back surface side of the first support disk board 25. Also, a pair of vertically spaced ridges 33, 33 are laterally disposed on the front surface side of the first support disk board 25. A pair of vertically spaced groove blocks 34, 34 are provided on a back surface of the second support disk board 28 and are slidably fitted to the ridges 33, 33, respectively. As a consequence, the first support disk board 25 can be moved smoothly in a vertical direction and the second support disk board 28 can be moved smoothly in a lateral direction.

The first support disk board 25 can be moved vertically along the threaded rod 26 by actuation of the first drive motor 27, whereas the second support disk board 28 can be moved laterally along the threaded rod 29 by actuation of the second driving motor 30.

A grinding drive motor 35 is disposed on and supported by the front surface of the second support disk board 28. A cutter unit 37 having an overall configuration like a bobbin when viewed from the front is operatively connected to the drive motor 35 through pulleys 36, 36' disposed therebetween.

The cutter unit 37 is supported by the second support disk board 28 such that the cutter unit 37 can be rotated about a lateral axis through a main shaft 39 which is supported by a bearing 38.

Figure 7:
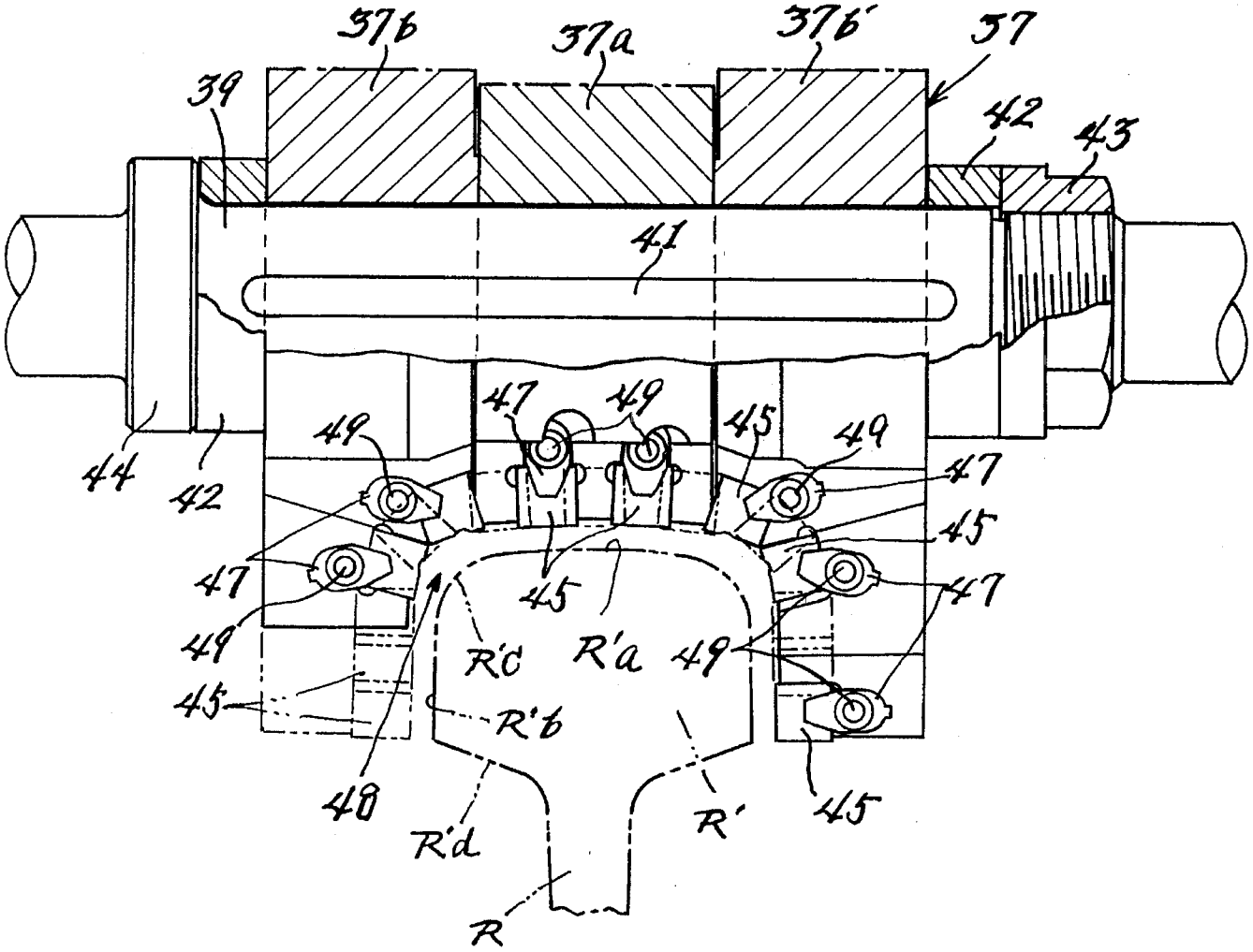
FIG. 7 is a front view, partly cut away, of a cutter unit.
Figure 8:
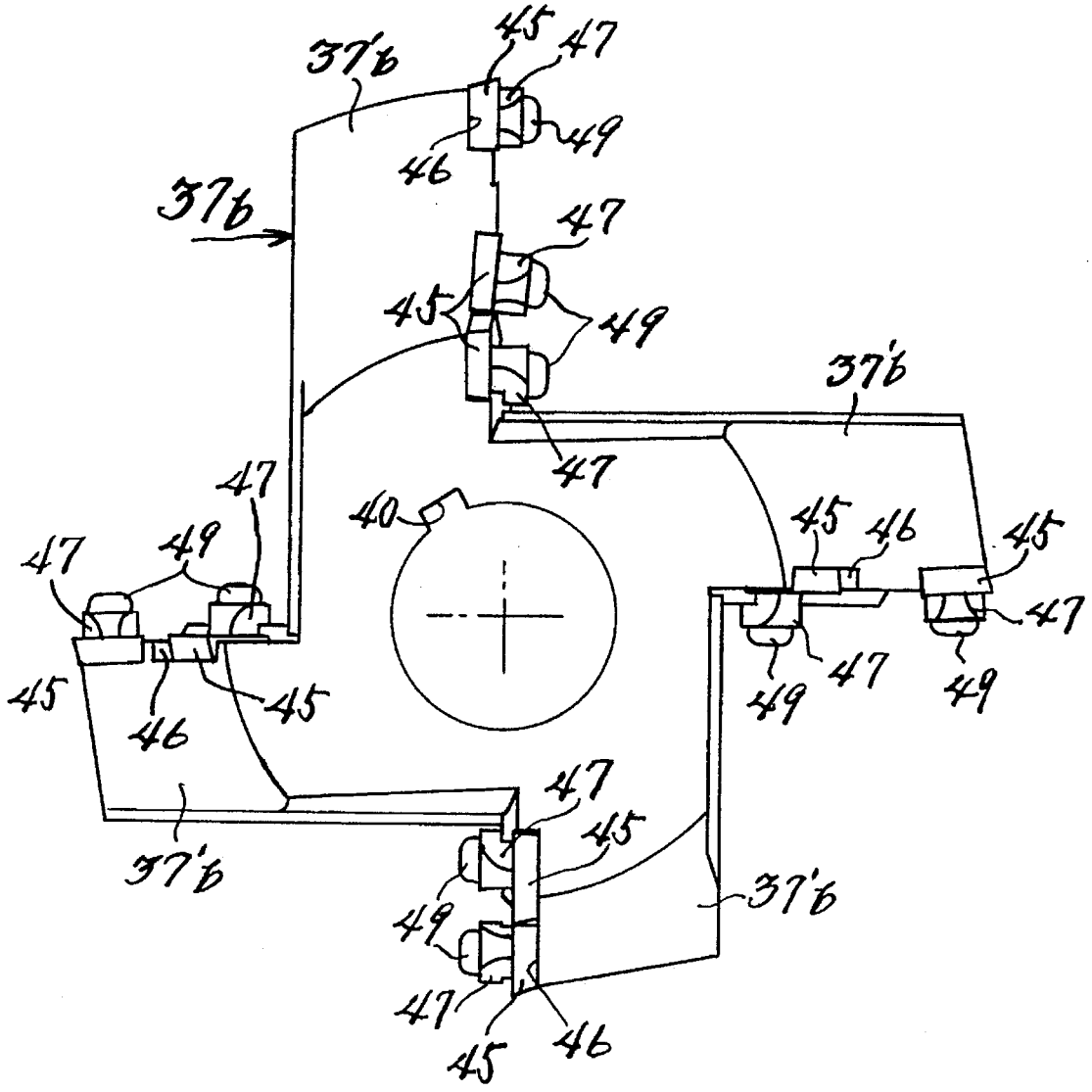
FIG. 8 is a side view of a first side constitutional section of the cutter unit.
Figure 9:
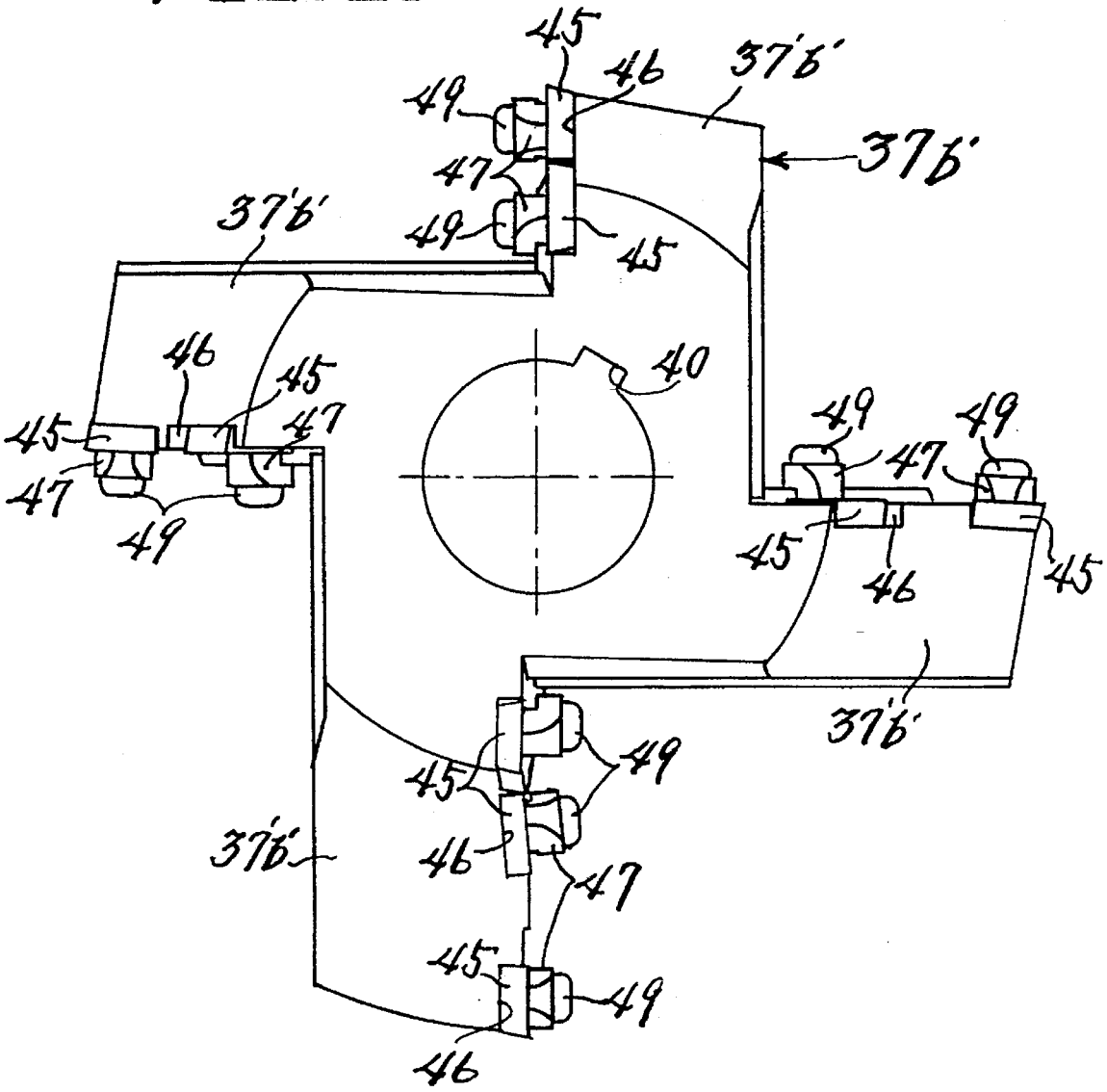
FIG. 9 is a side view of a second side constitutional section of the cutter unit.

In the cutter unit 37, generally symmetrical first side constitutional section *37b* and second side constitutional section *37b'* are disposed in opposing relation through a central constitutional section *37a*. A key 41 projecting from a peripheral side of the main shaft 39 is brought into engagement with key grooves 40, 40, 40 formed respectively in the constitutional sections *37a, 37b, 37b'*. Then, they are tightened to the main shaft 39 by a fixing nut 43 and a pressure receiving flange 44 formed on the main shaft 39, through rings 42, 42. As a consequence, the cutter unit 37 can be rotated in unison with the main shaft 39. When the cutter unit 37 is rotated about main shaft 39, the central portion along the main shaft 39 forms an engaging portion 48 which generally coincides with the surface contour (indicated in dotted outline in FIG. 7) of the rail head R'. In other words, an orbit configuration like a bobbin is exhibited as a whole. Grinding edges (or knives) 45 joined to the sections *37b, 37b'* and *37a* can be of super-hard chip or ceramic chip. However, the invention is not limited to use of these materials. That is, any material is acceptable as a grinding material as long as the grinding edges made of such a material can grind the rail head. The grinding edges 45 are arranged at selected locations such as shown in FIGS. 8–10 of the various constitutional sections *37a, 37b, 37b'* and detachably attached to the cutter unit 37.

Mounting recesses 46 are formed in the various constitutional sections *37a, 37b, 37b'* such that the recesses 46 are opened on their side forming the engaging portion 48. Distal ends of the grinding edges 45 are projected within the engaging portion 48 and base side of the grinding edges 45 are engaged with the mounting recesses 46. Then, distal ends of the pressing elements 47 are superimposed on the surface on the base side of the grinding edges 45 which are engaged with the mounting recesses 46. Distal ends of the securing screw 49 extend through the base portions of the pressing elements 47. Then, the distal ends of the securing screws 49 are threadedly engaged with and tightened to the constitutional sections 37*a*, 37*b*, 37*b*'. The grinding edges 45 are thus detachably attached to the constitutional sections 37*a*, 37*b*, 37*b*' of the cutter unit 37. The grinding edge 45 can be attached/detached by means of manipulation of the securing screw 49 and, therefore, can be easily replaced.

The grinding edges 45 are arranged at several locations in selected positions in the area of the engaging portion 48 of the cutter unit 37. With this feature, when the grinding operation is performed by rotating the grinding edges 45 in unison with the main shaft 39, the individual grinding edges 45 are partly contacted with the surface of the rail head portion R', so that the overall area including the upper surface R'a of the rail head, the arcuate surface R'c and the side surface R'b is worked on.

Figure 10:
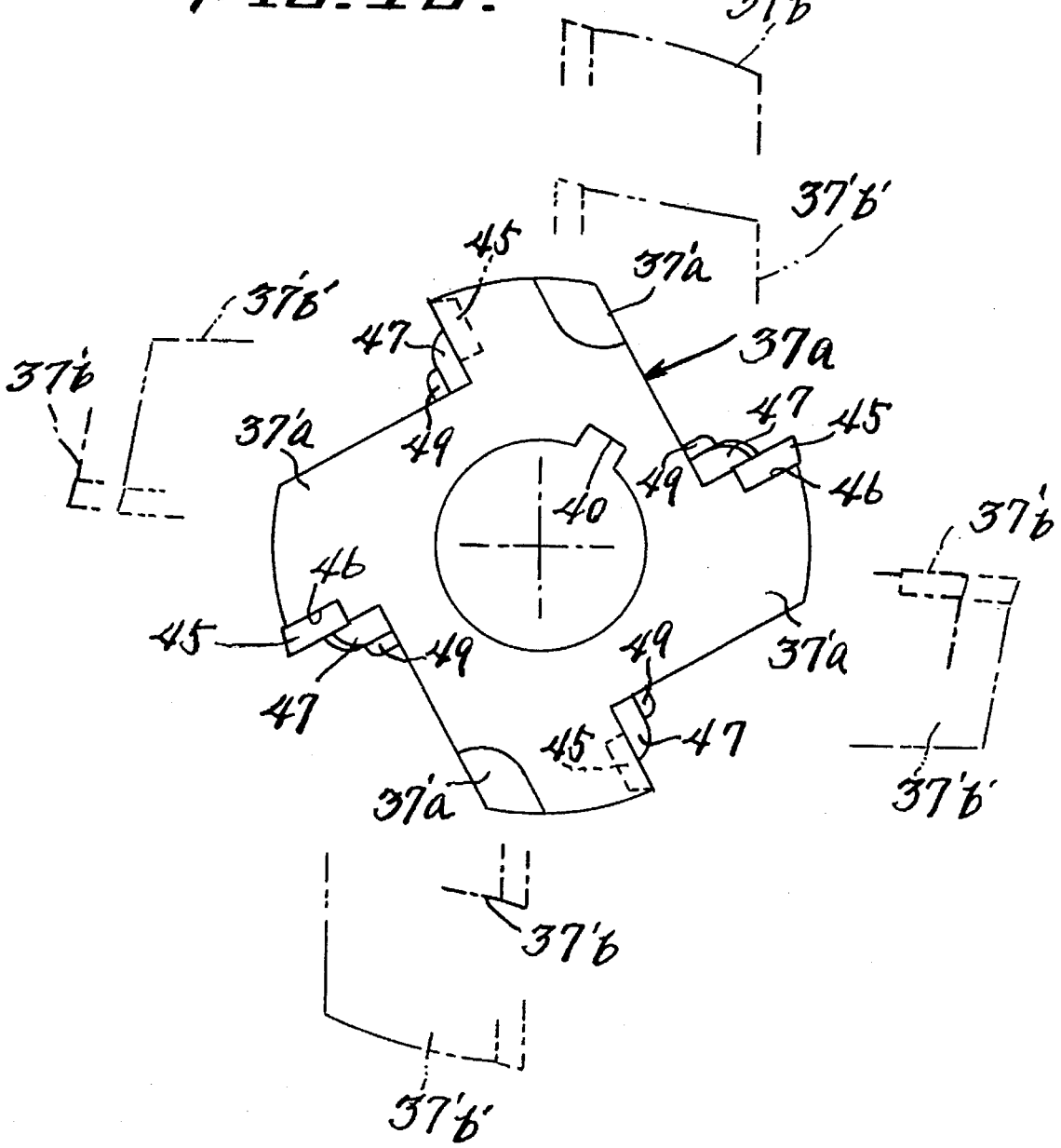
FIG. 10 is a side view of a central constitutional section integral with the cutter.

As shown in FIG. 10, the central constitutional section 37*a* constituting the cutter unit 37 exhibits a windmill-like configuration including four vanes when viewed from the side. Similarly, as shown in FIG. 8 or 9, the first and second side constitutional sections 37*b*, 37*b*' exhibit a windmill-like configuration including four vanes when viewed from the side. The grinding edges 45 are attached, as previously mentioned, to the single surface side of the vane portions 37'*a*, 37'*b*, 37'*b*' (although the vane portions of the central constitutional section 37*a* are of the same configuration, the vane portions 37'*b*, 37'*b*' of the first and second side constitutional section 37*b*, 37*b*' are different in length), respectively.

The grinding edges 45 of the central constitutional section 37*a* undertake the grinding of the overall area of the upper surface R'a of the rail head portion R', whereas the grinding edges 45 of the side constitutional sections 37*b*, 37*b*' undertake the grinding of the overall areas of the arcuate head surface R'*c* and side head surface R'*b*.

The constitutional sections 37*a*, 37*b*, 37*b*' of the cutter unit 37 are formed into a windmill-like configuration and the grinding edges 45 are attached to the vane portions 37'*a*, 37'*b*, 37'*b*'. Under this arrangement, the grinding edge 45 can be easily attached/detached. Since all of the grinding edges 45 provided on the central constitutional section 37*a*, for example, do not simultaneously contact the upper head surface R'a, contact resistance produced during the grinding operation can be reduced.

When the drive motors 13, 13' are actuated while actuating the hydraulic cylinders 7, 7', the drive gears 12, 12' are rotated about the motor axes 14, 14'.

Then, the driven gears 11, 11' engaged with the drive gears 12, 12' are rotated. Since the driven gears 11, 11' are secured to the upper members 4*a*, 5*a* of the pinch rollers 4, 5, the pinch rollers 4, 5 are rolled or rotated.

Consequently, the machine table 1 is brought to a predetermined position by the other pair of front and rear pinch rollers 4', 5' and the pair of front and rear carrier rollers 3, 3', which are rotated in accordance with the rotation of the pinch rollers 4 and 5.

When the control handle 23 is manipulated to rotate the threaded rod 21, the pinch rollers 4, 4', 5, 5' are more intimately contacted with the rail head portion R', thereby limiting the lateral movement of the machine table 1 relative to the rail head portion R'.

Since the pair of front and rear left side pinch rollers 4', 5' (when arranged on the reference side) are located in place relative to the machine table 1 and the other pair of front and rear right side pinch rollers 4, 5 on the reference side (the expression "reference side" used herein refers to opposing inner surface sides of a pair of rails disposed in parallel relation) is displaced, an imaginary line connecting the pinch rollers 4', 5' is in parallel relation to the reference line for the grinding operation, and the welded residues on the respective seams are uniformly ground along the rails R, R.

Figure 11:
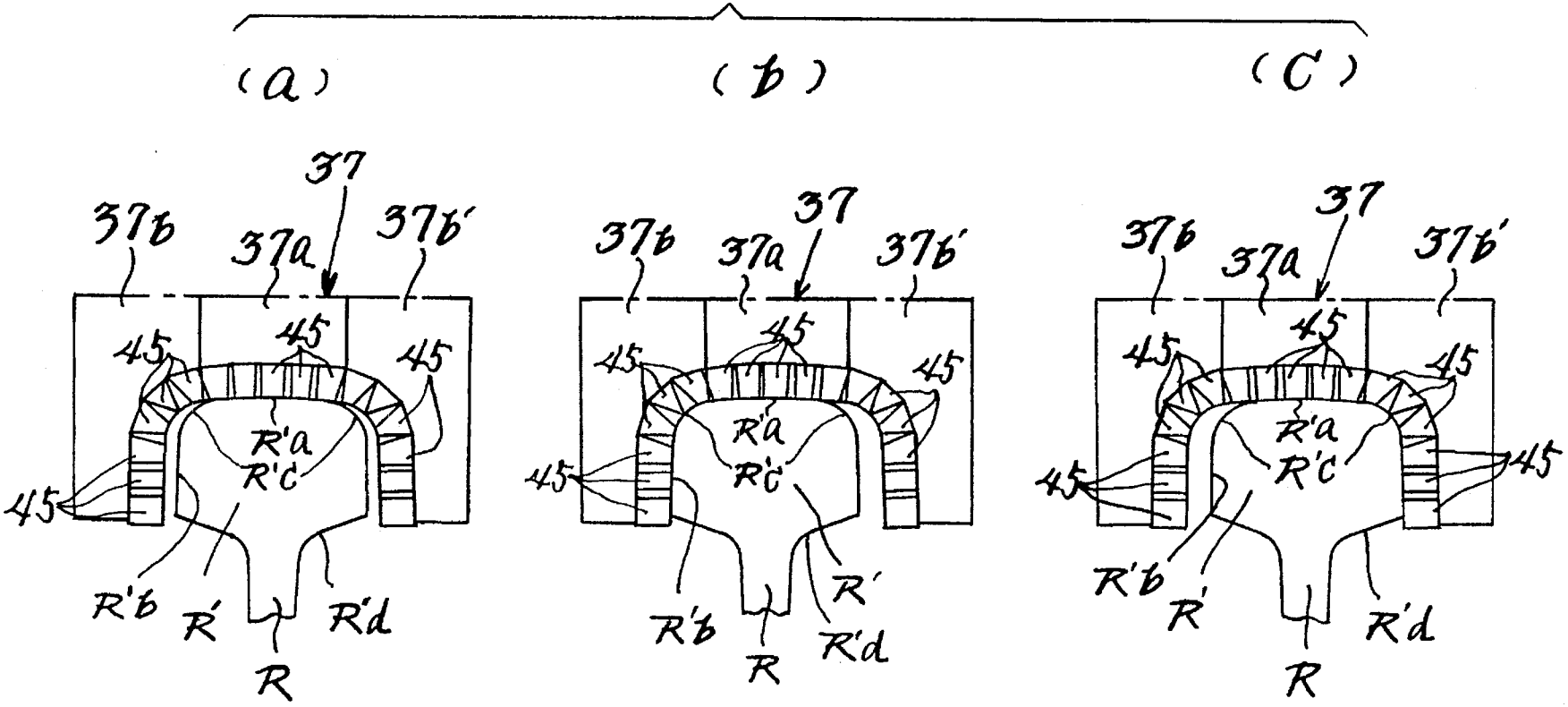
FIG. 11 is a schematic front view showing a relation between the cutter unit and the rail head portion.

When the grinding drive motor 35 is actuated and when the first drive motor 27 is actuated to lower the first support disk board 25, the grinding edges 45 provided on the central constituting section 37*a* of the cutter body 37 grind the head upper surface R'a, as shown in FIG. 11(*a*). Similarly, the second drive motor 30 is actuated to laterally move the second support disk board 28, the cutter unit 37 is moved toward the second drive motor 30 side, and thereafter, the first support disk board 25 is lowered by means of actuation of the first drive motor 27. Then, as shown in FIG. 11(*b*), the grinding edges 45 provided on the central constitutional section 37*a* of the cutter unit 37 grind the upper head surface R'a, whereas the grinding edges 45 provided on the first side constitutional section 37*b* grind the arcuate surface R'*c* and side surface R'*b* on one side (reference side) of the rail head R'. When the second drive motor 30 moves the second support disk board 28 in a direction away from the second drive motor 30, the grinding edges 45 provided on the central constitutional section 37*a* of the cutter unit 37 grind the upper head surface R'a, whereas the grinding edges 45 provided on the second side constitutional section 37*b*' grind the arcuate surface R'c and side surface R'b on the other side with respect to the reference side of the rail head R'.

If it is desired to grind only the side head surface R'b, the first support disk board 25 is raised upward to bring the grinding edges 45 away from the upper surface R'a and the grinding edges 45 of the first or second constitutional sections 37*b*, 37*b*' are brought into contact with the side head surface R'b.

Although not illustrated, the machine table 1 is provided with an electric board for receiving a signal from a sensor contacting an appropriate part of the rail head. The electric board is operatively connected to the drive motors 13, 13', 27, 30, 35, etc. and the grinding edges are remote controlled so that they can grind the rail with high accuracy.

Instead of the first and second drive motors 27 and 30, the control handle may be attached to the threaded rods 26, 29 so that the first and second support disk boards 25, 28 are manually operated.

Since the present invention is constructed in the manner mentioned above, by vertically moving the first support disk board or laterally moving the second support disk board while appropriately moving the machine table forwardly and backwardly as desired, the welded residue can be ground by the grinding edges contacting the upper surface, arcuate surface and side surface of the rail head in various manners. Since the load of the grinding drive motor can be applied to the cutter unit, the grinding operation can be performed in a more reliable manner.

According to the invention as claimed, the machine table loaded with the cutter unit, etc. is correctly positioned on the rail head portion by the pinch rollers during the grinding operation, and therefore, movement of the machine table, which would otherwise be caused by the grinding operation, is limited. As a consequence, lowering of the grinding accuracy caused by movement of the machine table can be prevented.

Also, according to the invention as claimed, the grinding operation can be performed with reference to the side head surface which a pair of front and rear pinch rollers on one side contact. Accordingly, non-uniformity of the welded residues on the seam can be absorbed, the reference line for the grinding work can be established automatically, and the grinding operation can be performed efficiently.

Also, in accordance with the invention as claimed, the rail head can be positively pinched between the pinch rollers by using the hydraulic cylinders. According to the invention as claimed, the pinch rollers are rotated irrespective of the machine table, so that a smooth grinding operation is performed.

Further, in accordance with the invention as claimed, the rail head can be easily pinched between the pinch rollers by manipulating the control handle.

In addition, according to the invention as claimed, a cutter unit for grinding a rail head can be easily obtained. Also, according to the invention as claimed, wear and damage of the grinding edges can be resolved. Still further, according to the invention as claimed, the grinding edge or edges can be easily replaced.

Additionally, in accordance with the invention as claimed, merely by moving the overall cutter unit forwardly and backwardly, rightwardly and leftward, upwardly and downwardly, a right part of the rail head can be ground and a contact resistance produced during the grinding operation can be reduced.

Also, according to the invention as claimed, the time required for grinding operation can be reduced compared with the conventional grinder.

It is to be understood that the form of the invention herewith shown and described is taken as the preferred embodiment of the same, and that various changes in the shape, size and arrangement of parts may be resorted to without departing from the spirit of the invention or the scope of the subjoined claims.

What is claimed is:

1. A grinding apparatus for rails for grinding a welded residue on a seam of a head portion of a rail, comprising:

a machine table capable of moving forward and backward along a rail, said machine table having a distal end portion;

an apparatus base provided on the distal end portion of said machine table;

a first support disk board mounted on said apparatus base for vertical movement;

a second support disk board having a front surface and being mounted on said first support disk board for vertical movement;

a grinding drive motor mounted on the front surface of said second support disk to provide rotation about a horizontal axis;

a cutter unit mounted on the front surface of said second support disk to provide rotation about the horizontal axis, said cutter unit being operatively connected to said grinding drive motor;

an engaging portion formed on said cutter unit and adapted to engage a head portion of said rail wherein the head portion of the rail, in cross-section, includes an upper surface, opposite arcuate surfaces, opposite side surfaces, and opposite lower surfaces; and a plurality of grinding edges disposed on said engaging portion to grind the upper surface, one of said arcuate surfaces and one of said side surfaces of the head portion of the rail;

at least one pair of front carrier rollers and one pair of rear carrier rollers on said machine table for rolling contact on the upper surface of the head portion of the rail;

a pair of right and left pinch rollers depending from a machine table proximate each pair of said front and rear carrier rollers, said pinch rollers being constituted of an upper member formed to make rolling contact with the upper surface and the opposite side surfaces of the head portion of said rail and a lower member formed to make rolling contact with the lower surfaces of the head portion of the rail; and, a hydraulic cylinder unit corresponding to each of said pinch rollers being mounted on said machine table and adapted to cause said upper and lower members of said pinch rollers to intimately contact the head portion of said rail.

2. The apparatus as claimed in claim 1 wherein one of the right and left pinch rollers on one side of the head portion of said rail is fixedly mounted to said machine table, and the other of said right and left pinch rollers on the other side of the head portion of said rail is mounted on said machine table for adjustable positioning in a direction toward and away from the one pinch roller on the one side of said head portion of said rail.

3. A grinding apparatus as claimed in claim 2, wherein a thrust bearing is located in an intermediate block on the other side of said right and left pinch rollers at said other side of the head portion of said rail, said intermediate block being provided with a threaded hole horizontally formed therein, a threaded rod being threadedly engaged with said thread hole, opposite end portions of said threaded rod being rotatably supported by a support element disposed on said machine table such that one end of the threaded rod projects from said machine table, a control handle being attached to said one end of said threaded rod projecting from said machine table through said support element.

4. A grinding apparatus as claimed in claim 3, wherein said cutter unit includes a central constitutional section provided with at least one of said grinding edges for grinding the upper surface of the head portion of the rail, a pair of first and second side constitutional sections sandwiching the central constitutional section, each of said first and second side constitutional sections being provided with at least one of said grinding edges for grinding the arcuate surface and the side surfaces of the head portion of said rail, said central and said first and second side constitutional sections being supported on and keyed to a main shaft engageable with the grinding drive motor.

5. The apparatus as claimed in claim 2 wherein each said hydraulic cylinder unit includes a piston rod and each of said pinch rollers are rotatably supported on respective said piston rods of said hydraulic cylinders.

6. The apparatus as claimed in claim 1 wherein each said hydraulic cylinder unit includes a piston rod and each of said pinch rollers are rotatably supported on respective said piston rods of said hydraulic cylinders.

7. A grinding apparatus as claimed in claim 6, wherein a thrust bearing is disposed between said machine table and each of said pinch rollers, said piston rod extending through said thrust bearing and said pinch rollers, whereby one side of said thrust bearing can make pressure contact with the machine table and another side of said thrust bearing can make pressure contact with the upper member of said pinch rollers.

8. A grinding apparatus as claimed in claim 7, wherein a thrust bearing is located in an intermediate block on the other side of said right and left pinch rollers at said other side of the head portion of said rail, said intermediate block being provided with a threaded hole horizontally formed therein, a threaded rod being threadedly engaged with said thread hole, opposite end portions of said threaded rod being rotatably supported by a support element disposed on said machine table such that one end of the threaded rod projects from said machine table, a control handle being attached to said one end of said threaded rod projecting from said machine table through said support element.

9. A grinding apparatus as claimed in claim 1, wherein said cutter unit includes a central constitutional section provided with at least one of said grinding edges for grinding the upper surface of the head portion of the rail, a pair of first and second side constitutional sections sandwiching the central constitutional section, each of said first and second side constitutional sections being provided with at least one of said grinding edges for grinding the arcuate surface and the side surfaces of the head portion of said rail, said central and said first and second side constitutional sections being supported on and keyed to a main shaft engageable with the grinding drive motor.

10. A grinding apparatus as claimed in claim 9, wherein said grinding edges are detachably secured to said cutter unit.

11. A grinding apparatus as claimed in claim 10, wherein said cutter unit is provided with a mounting recess for each of said grinding edges such that said grinding edges are engaged in said mounting recesses, each said grinding edge being secured in said respective mounting recesses by a pressing element and a fastening screw.

12. A grinding apparatus as claimed in claim 9, wherein said grinding edges are disposed at a plurality of predetermined locations on said cutter unit such that rotation of said cutter unit provides a rotating orbit of said grinding edges that coincides with the surface of the head portion of the rail.

13. A grinding apparatus as claimed in claim 9, wherein said grinding edges are made of ceramic chip.

* * * * *